US010389031B2

(12) United States Patent
Sanpo et al.

(10) Patent No.: US 10,389,031 B2
(45) Date of Patent: Aug. 20, 2019

(54) ANTENNA DEVICE

(71) Applicants: YOKOWO CO., LTD., Tokyo (JP); HONDA MOTOR CO., LTD., Tokyo (JP)

(72) Inventors: Takeshi Sanpo, Tomioka (JP); Mutsumi Katayama, Saitama (JP); Yasuhiro Konno, Saitama (JP)

(73) Assignees: YOKOWO CO., LTD., Tokyo (JP); HONDA MOTOR CO., LTD., Tokyo (JP)

( * ) Notice: Subject to any disclaimer, the term of this patent is extended or adjusted under 35 U.S.C. 154(b) by 78 days.

(21) Appl. No.: 15/709,757

(22) Filed: Sep. 20, 2017

(65) Prior Publication Data

US 2018/0083361 A1 Mar. 22, 2018

(30) Foreign Application Priority Data

Sep. 22, 2016 (JP) ..... 2016-184959

(51) Int. Cl.

| | |
|---|---|
| ***H01Q 21/00*** | (2006.01) |
| ***H01Q 9/28*** | (2006.01) |
| ***H01Q 9/04*** | (2006.01) |
| ***H01Q 21/28*** | (2006.01) |
| *H01Q 1/24* | (2006.01) |
| *H01Q 9/30* | (2006.01) |

(52) U.S. Cl.

CPC ..... *H01Q 9/28* (2013.01); *H01Q 9/0428* (2013.01); *H01Q 9/285* (2013.01); *H01Q 21/28* (2013.01); *H01Q 1/241* (2013.01); *H01Q 9/30* (2013.01)

(58) Field of Classification Search

CPC ..... H01Q 21/28; H01Q 21/24; H01Q 5/0006; H01Q 9/16; H01Q 1/38; H01Q 9/28

USPC ..... 343/727, 893, 793, 726

See application file for complete search history.

(56) References Cited

U.S. PATENT DOCUMENTS

2013/0082898 A1* 4/2013 Asanuma ..... H01Q 1/48 343/893
2017/0319102 A1* 11/2017 Greene ..... H01L 25/167

FOREIGN PATENT DOCUMENTS

JP 2011-193432 A 9/2011

* cited by examiner

*Primary Examiner* — Dameon E Levi
*Assistant Examiner* — Collin Dawkins
(74) *Attorney, Agent, or Firm* — Leydig, Voit & Mayer

(57) ABSTRACT

An antenna device includes a first plate-shaped metal plate and a second plate-shaped metal plate configuring a bow-tie antenna. The first plate-shaped metal plate and the second plate-shaped metal plate extend upwardly and downwardly from a feeding point, respectively. The feeding point is located at a position offset in a positive x direction from an x-direction center position of the first plate-shaped metal plate. A magnetic core is mounted on a feeder line that is a coaxial cable. The magnetic core is accommodated between a negative x-direction side end portion of the first plate-shaped metal plate and the feeding point, in the x direction.

9 Claims, 5 Drawing Sheets

1 Antenna Device

1 Antenna Device

Typical Bow-Tie Antenna

Typical Bow-Tie Antenna + Ferrite Core

2 Antenna Device

3 Antenna device

3 Antenna Device

3 Antenna Device

3 Antenna Device

ANTENNA DEVICE

BACKGROUND OF THE INVENTION

Field of the Invention

The present invention relates to an antenna device including a bow-tie antenna.

Description of the Related Art

FIG. 2 is a schematic configuration diagram of a typical bow-tie antenna. The bow-tie antenna shown in FIG. 2 includes antenna elements 110, 120 respectively extending in upper and lower directions from a feeding point 5. Each of the antenna elements 110, 120 is an isosceles-triangular metal plate having the feeding point 5 at the apex. The feeding point 5 is located on an imaginary line Lc connecting the middle points of the bases of the antenna elements 110, 120. A feeder line 31 is connected to the feeding point 5. The bow-tie antenna can cover a wide frequency band of LTE (Long Term Evolution) etc.

PATENT LITERATURE 1

Japanese Laid-Open Patent Publication No. 2011-193432

In general, a coaxial cable is used for a feeder line transmitting a high frequency from the viewpoint of suppression of influence of external electromagnetic waves, reduction in loss due a leakage power, etc. While the coaxial cable is an unbalanced feeder line, the bow-tie antenna is a balanced antenna and, therefore, when the coaxial cable is used as the feeder line 31 of the bow-tie antenna (when the bow-tie antenna and the coaxial cable are connected), a problem occurs that a leakage current flows through an outer conductor of the coaxial cable. Therefore, as shown in FIG. 3, by mounting a cylindrical magnetic core 71 (e.g., a ferrite core) on the coaxial cable, the leakage current can be suppressed over a wide band.

However, in the configuration of FIG. 3, the magnetic core 71 protrudes from the configuration range of the bow-tie antenna. Specifically, the magnetic core 71 significantly extends outward beyond an imaginary line Le extending vertically and passing through the left end of at least one of the antenna elements 110, 120 in FIG. 3. Therefore, in the configuration of FIG. 3, a case not shown holding the antenna elements 110, 120 and the magnetic core 71 must be made larger in accordance with an amount of protrusion of the magnetic core 71, causing a problem of an increased size at the time of productization as an antenna device.

SUMMARY OF THE INVENTION

The present invention was conceived based on recognition of these problems and it is therefore an object of the present invention to provide an antenna device capable of restraining an increase in size while suppressing a leakage current in a configuration including a bow-tie antenna.

A first aspect of the present invention is a antenna device. The antenna device comprising:

a bow-tie antenna;

a first coaxial cable connected to the bow-tie antenna; and a first magnetic core penetrated by the first coaxial cable, wherein when three respective orthogonal axes are an x axis, a y axis, and a z axis, the bow-tie antenna includes a first plate-shaped metal having a portion extending from a feeding point in the +z direction in substantially parallel to the xz plane and a second plate-shaped metal having a portion extending from the feeding point in the −z direction in substantially parallel to the xz plane, wherein the first magnetic core is located on the −x-direction side of the feeding point and within an existence range of the first and second plate-shaped metals in the z direction and has a position in the x direction overlapping with the first and second plate-shaped metals, and the feeding point is located at a position offset in the +x direction from an x-direction center position of the first plate-shaped metal or an x-direction center position of the second plate-shaped metal.

The first magnetic core may be accommodated between a −x-direction side end portion of the first or second plate-shaped metal and the feeding point in the x direction.

The axial direction of the first magnetic core may be substantially parallel to the x direction A second aspect of the present invention is a antenna device. The antenna device comprising:

a bow-tie antenna;

a first coaxial cable connected to the bow-tie antenna; and a first magnetic core penetrated by the first coaxial cable, wherein the bow-tie antenna has a substantially triangular first plate-shaped metal and a substantially semicircular second plate-shaped metal, and wherein for a feeding point serving as a mutual contact point between the first and second plate-shaped metals, a distance to an apex of the first plate-shaped metal on the side disposed with the first magnetic core is longer than a distance to an apex on the opposite side.

A third aspect of the present invention is a antenna device. The antenna device comprising:

a bow-tie antenna;

a first coaxial cable connected to the bow-tie antenna, a second coaxial cable connected to an antenna different from the bow-tie antenna, a first magnetic core penetrated by the first coaxial cable; and a second magnetic core penetrated by the second coaxial cable, wherein when three respective orthogonal axes are an x axis, a y axis, and a z axis, the bow-tie antenna includes a first plate-shaped metal having a portion extending from a feeding point in the +z direction in substantially parallel to the xz plane and a second plate-shaped metal having a portion extending from the feeding point in the −z direction in substantially parallel to the xz plane, wherein the second plate-shaped metal has a convex curved portion having a shorter dimension in the z-direction than the first plate-shaped metal and curved to approach parallel to the z direction as the portion extends in the −x direction from the feeding point that is a contact point with the first plate-shaped metal, and one of the first and second magnetic cores is disposed on the second plate-shaped metal side in the z direction.

The antenna device further may comprise an antenna different from the bow-tie antenna, second and third coaxial cables connected to the different antenna, and second and third magnetic cores respectively penetrated by the second and third coaxial cables, wherein the first to third magnetic cores are stacked in trefoil formation.

Any arbitrary combination of the above-described constituent elements and the descriptions of the present invention which are converted between methods and systems are all effective as aspects of the present invention.

The present invention enables provision of the antenna device capable of restraining an increase in size while suppressing a leakage current in a configuration including a bow-tie antenna.

DESCRIPTION OF THE PREFERRED EMBODIMENTS

Figure 1:
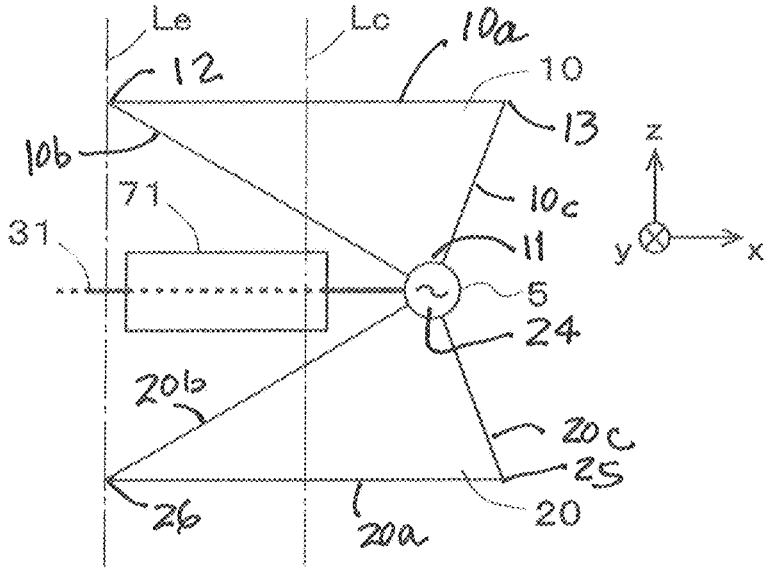
FIG. 1 is a schematic configuration diagram of an antenna device 1 according to a first embodiment of the present invention.

Now, preferred embodiments of the present invention will be described in detail, referring to the drawings. The same or equivalent constituent elements, members and so on which are shown in the respective drawings are denoted with the same reference numerals, and overlapped descriptions are appropriately omitted. Moreover, the present invention is not limited to the embodiments, but the embodiments are only examples. All features and the combinations of the features which are described in the embodiments are not absolutely essential to the present invention.

First Embodiment

FIG. 1 is a schematic configuration diagram of an antenna device 1 according to a first embodiment of the present invention. In FIG. 1, x-, y-, and z-axes are defined as three orthogonal axes. The antenna device 1 includes a first plate-shaped metal 10 and a second plate-shaped metal 20 constituting a bow-tie antenna. The first plate-shaped metal 10 has a triangular shape having three edges, i.e., sides, 10*a*, 10*b*, and 10*c*, and three vertexes 11, 12, and 13, respectively opposite the edges 10*a*, 10*b*, and 10*c*. The first plate-shaped metal 10 extends in the +z direction from a feeding point 5 in the xz plane and has the feeding point 5 at the first vertex 11 of the first triangular first plate-shaped metal 10, opposite the first edge 10*a*. The first plate-shape metal 10 extends in the −x direction to a second 12 that is an end point of the first plate-shaped metal. The second plate-shaped metal 20 has a triangular shape having three edges, i,e., sides, 20*a*, 20*b*, and 20*c*, and three vertexes 24, 25, and 26, respectively opposite the edges 20*a*, 20*b*, 20*c*. The second plate-shaped metal 20; extends the −z direction from the feeding point 5 in the xz plane and has the feeding point 5 at the first vertex 24 of the triangular second plate-shaped metal 20, opposite the edge 20*a*. The second plate-shaped metal 20 extends in the −x direction to a vertex 26 that is an end point of the second plate-shaped 20. To the feeding point 5, a feeder line 31 is connected as a first coaxial cable. On the feeder line 31, a tubular (e.g., cylindrical) magnetic core 71 (e.g., ferrite core) having a central axis is mounted for reducing leakage current. Therefore, the feeder line 31 penetrates, i.e., passes through the magnetic core 71. The axial direction i.e., central axis, of the magnetic core 71 is substantially parallel to the x direction. The magnetic core 71 is located on the −x direction side of the feeding point 5 and within the existence range of the first plate-shaped metal 10 and the second plate-shaped metal 20 in the z direction, i.e., the magnetic core 71 does not extend beyond the first plate-shaped metal 10 and the second plate-shaped metal 20, along the z axis when viewed along the axis, perpendicular to the xz plane as shown I Fig. 1.

Figure 2:
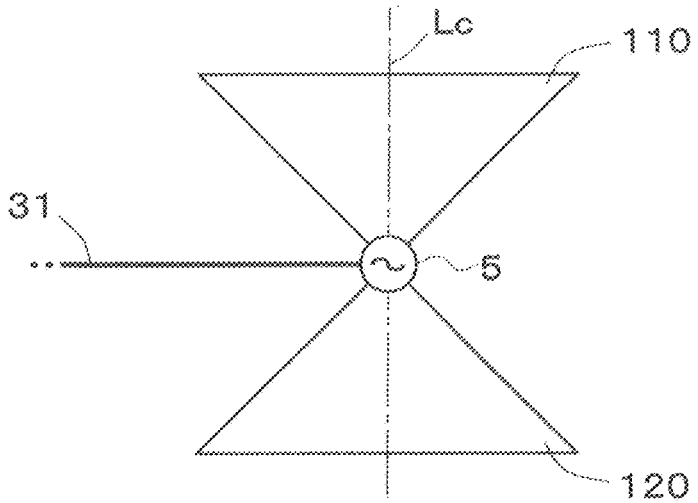
Fig. 2 Prior Art
FIG. 2 is a schematic configuration diagram of a typical bow-tie antenna.
Figure 3:
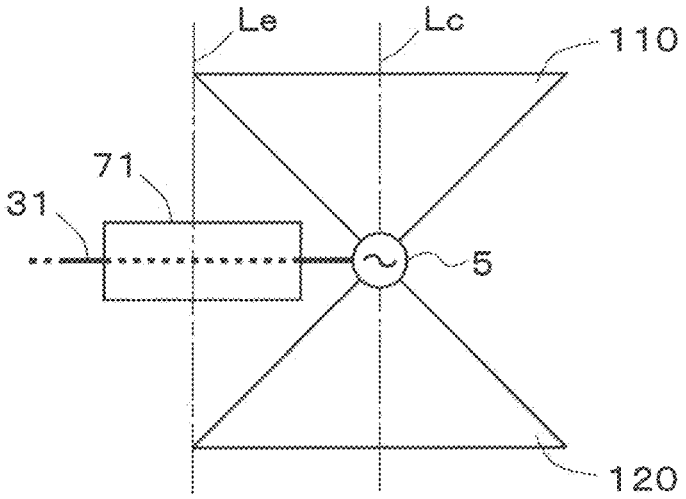
FIG. 3 is a schematic configuration diagram when a magnetic core 71 is mounted on a feeder line 31 in the configuration of FIG. 2.

In this embodiment, unlike the bow-tie antenna shown in FIG. 2, the feeding point 5 is located at a position offset in the +x direction from at least of the x-direction center of the first edge 10*a*of the first plate-shaped metal 10 and the x-direction center of the first edge 20*a*of the second plate-shaped metal 20. Therefore, the feeding point 5 is shifted by a predetermined distance in the +x direction with respect to an imaginary line Lc parallel to the z direction and passing through the center of at least one of the of the first edges of the first plate-shaped metal 10 or the second plate-shaped metal 20 Thus, in this embodiment, as compared to the bow-tie antenna shown in FIG. 2, a larger distance is present between the feeding point 5 and an imaginary line Le parallel to the z direction and tangent to at least one of the vertexes 12 and 26 at the end point of the first plate-shaped metal 10 and the second plate-shaped metal 20. Therefore, in this embodiment, unlike the case of FIG. 3, the magnetic core 71 is entirely between, and does not protrude from the imaginary line Le and the feeding point 5. In other words, the magnetic core 71 is accommodated between at least one of the first vertexes 12 and 26 of the first plate-shaped metal 10 or the second plate-shaped metal 20 and the feeding point 5 when viewed along the y axis, perpendicular to the xz plane as shown in FIG. 1. Therefore, according to this embodiment, as compared to the configuration shown in FIG. 3, a case not shown holding the first plate-shaped metal 10, the second plate-shaped metal 20, and the magnetic core 71 can be reduced in size, so as to restrain an increase in product size while suppressing leakage current. If the offset amount of the feeding point 5 in the +x direction is small, the magnetic core 71 may still protrude from the imaginary line Le toward the −x-direction; however, as compared to the configuration shown in FIG. 3, the protrusion amount is reduced because the magnetic core 71 is at least partially between the imaginary line Le and the feeding point 5 when viewed along the axis perpendicular to the xz plane so that the effect of restraining an increase in size can be acquired. The shapes of the first plate-shaped metal 10 and the second plate-shaped metal 20 may not be symmetrical to each other.

Second Embodiment

Figure 4:
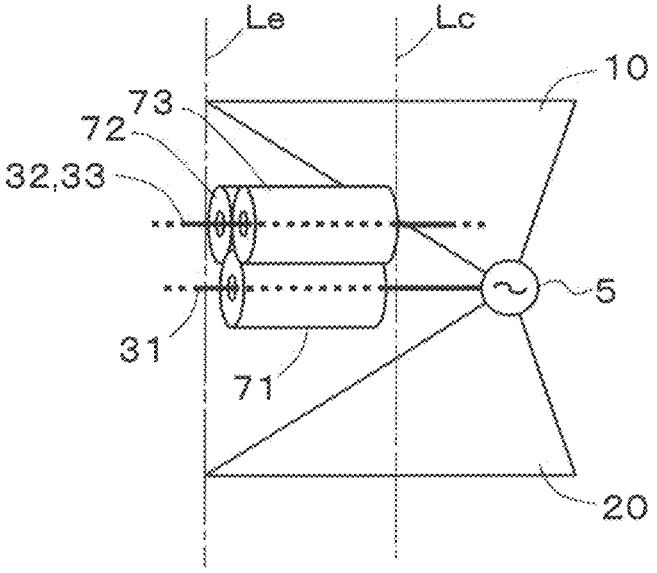
FIG. 4 is a schematic perspective view of an antenna device 2 according to a second embodiment of the present invention.

FIG. 4 is a schematic perspective view of an antenna device 2 according to a second embodiment of the present invention. The antenna device 2 of this embodiment is identical to the antenna device of the first embodiment shown in FIG. 1 except that the bow-tie antenna made up of the first plate-shaped metal 10 and the second plate-shaped metal 20 is combined with other antennas not shown, resulting in three output systems. Feeder lines 32, 33 are provided as second and third coaxial cables for the additional two output systems. On the respective feeder lines 32, 33, tubular (e.g., cylindrical) magnetic cores 72, 73 (e.g., ferrite cores) are mounted for reducing a leakage current (the feeder lines 32, 33 respectively penetrate the magnetic cores 72, 73). The magnetic cores 71 to 73 have the same x-direction positions as each other and the axial direction substantially parallel to the x direction. In this embodiment, a space is saved by arranging the magnetic cores 71 to 73 in trefoil formation (formation of stacked bales). This embodiment can produce the same effects as the first embodiment.

Third Embodiment

Figure 5:
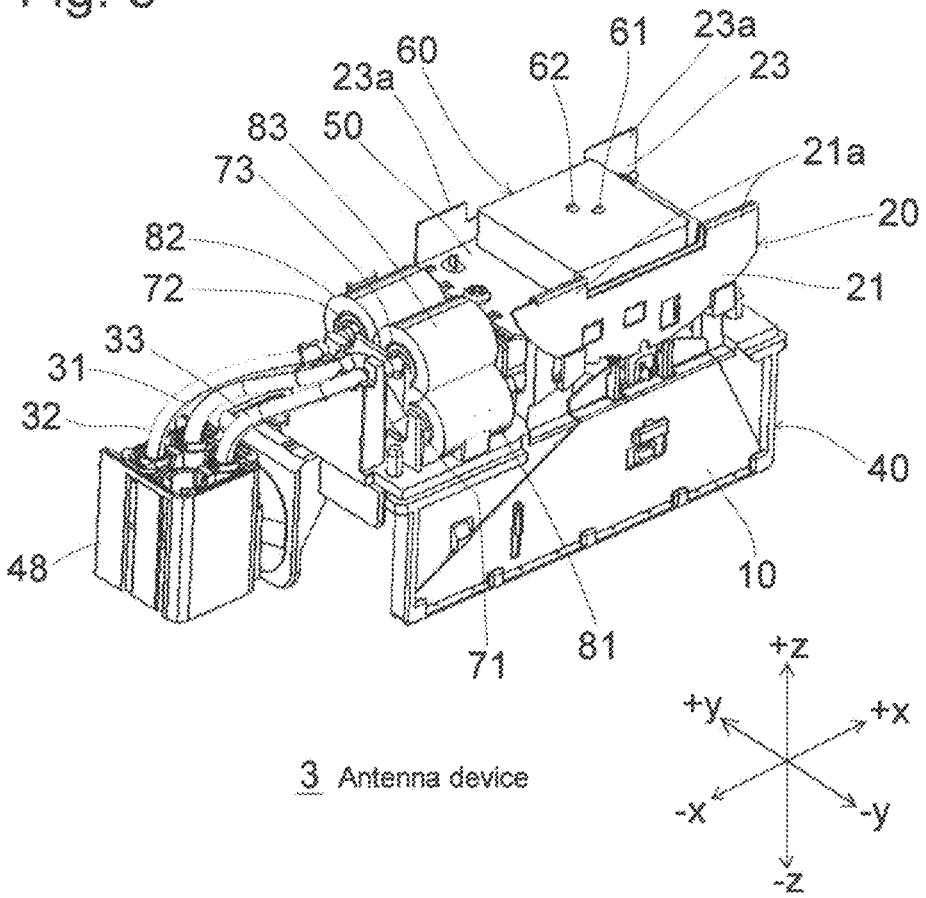
FIG. 5 is a perspective view of an antenna device 3 according to a third embodiment of the present invention with a cover 80 removed.
Figure 6:
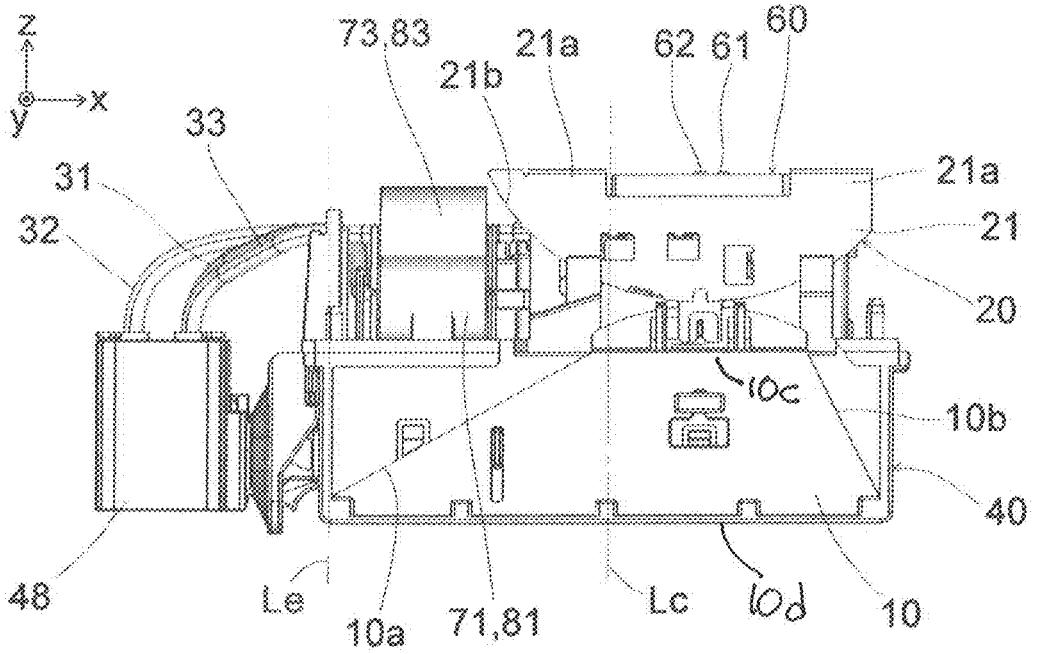
FIG. 6 is a right side view of the same.
Figure 7:
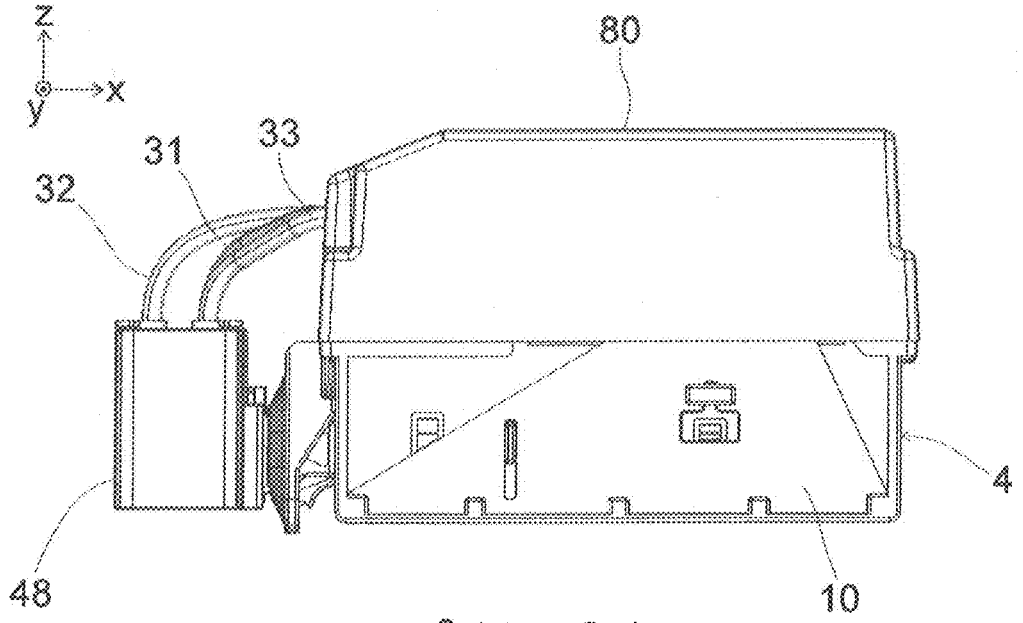
FIG. 7 is a right side view of the antenna device 3 with the cover 80 attached.
Figure 8:
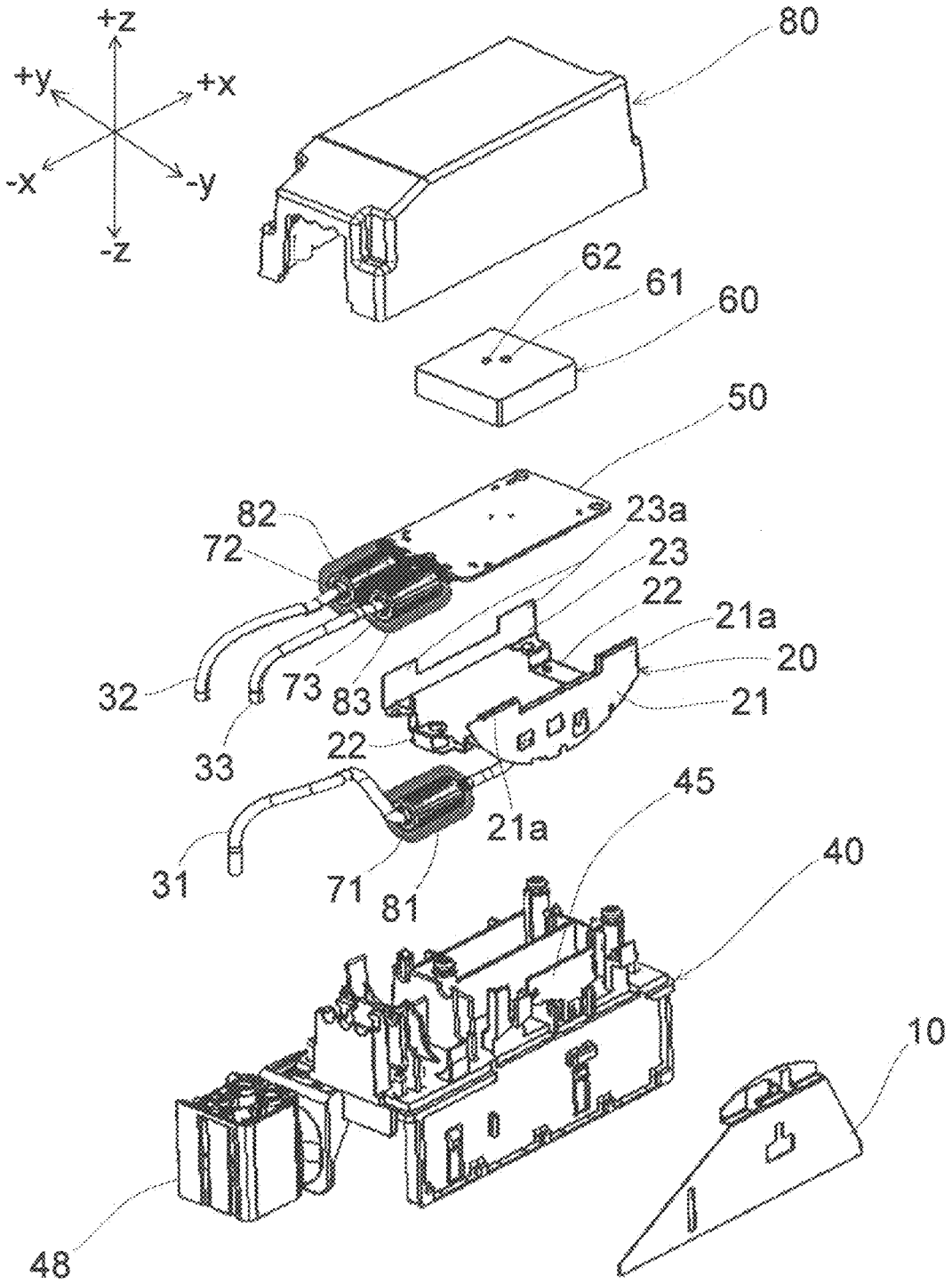
FIG. 8 is an exploded perspective view of the antenna device 3.

FIG. 5 is a perspective view of an antenna device 3 according to a third embodiment of the present invention with a cover 80 removed. FIG. 6 is a right side view of the same. FIG. 7 is a right side view of the antenna device 3 with the cover 80 attached. FIG. 8 is an exploded perspective view of the antenna device 3. The antenna device 3 is formed by combining, for example, a bow-tie antenna capable of transmitting and receiving a frequency band of a mobile phone and a patch antenna capable of transmitting and receiving frequency bands of GPS (Global Positioning System) and GLONASS (Global Navigation Satellite System), and has three output systems. GPS and GLONASS are included in GNSS (Global Navigation Satellite Systems). It is noted that only either one of GPS and GLONASS may be included.

In the antenna device 3, the first plate-shaped metal 10, the second plate-shaped metal 20, and a TEL antenna substrate 45 constitute the bow-tie antenna. A GNSS antenna substrate 50 and a GNSS antenna element 60 constitute the patch antenna. A base (lower case) 40 is made of an insulating resin, for example, and holds the first plate-shaped metal 10, the second plate-shaped metal 20, the TEL antenna substrate 45, the GNSS antenna substrate 50, and magnetic cores 71 to 73. The cover (upper case) 80 is made of an insulating resin, for example, and attached to the base 40 from above (the +z-direction side) to cover the whole except the second plate-shaped metal 20.

In the antenna device 3, the first plate-shaped metal 10 has a substantially trapezoidal shape include edges 10*a*, 10*b*, 10*c*, and 10*d*, and is engaged and held substantially parallel to the xz plane by claws etc. on a side surface (a side surface parallel to the xz plane facing in the −y direction) of the base 40. The edges 10*c* and 10*d* are parallel to the x axis and are connected by the edges 10*a* and 10*b* . The edge 10*a* extends from the feeding point of the first plate-shaped metal 10, between the edges 10*c* and 10*d*, and is longer than the edge 10*b* that also extends between the edges 10*c* and 10*d* and is opposite edge 10*a*. In others words, for the feeding point serving as the mutual contact point between the first plate-shaped metal 10 and the second plate-shaped metal 20, the distance a vertex formed by edges 10*a* and 10*c*, of the first plate-shaped metal 10, in the −x-direction side (the side including the magnetic cores 71 to 73) is longer than the distance to a vertex formed by the edges 10*c* and 10*d* on the opposite side (the +x-direction side). The second plate-shaped metal 20 is fixed to the upper surface of the base 40 by a screw etc. Specifically, the second plate-shaped metal 20 has respective protruding portions 21*a* protruding in the +z direction on respective x-direction ends of the second plate-shaped metal 20 and protruding in the +z-direction from the side of the second plate-shaped metal 20 that has a substantially semicircular principal surface portion 21 that is substantially flush with the first plate-shaped metal 10. The second plate-shaped metal 20 is folded at upper end portions of the protruding portions 21*a* toward the −z direction and extended by respective connecting portions 22 toward the +y direction such that a vertically extending portion 23 stands from +y-direction side end portions of the connecting portions 22, and the connecting portions 22 are screwed and fixed to the upper surface of the base 40. In the second plate-shaped metal 20, portions other than the principal surface portion 21 also act as an antenna element. The second plate-shaped metal 20 has a shorter dimension in the z-direction than the first plate-shaped metal 10, and has a convex curved portion 21*b* (FIG. 6) curved to approach parallel to the z direction (parallel to the imaginary line Le) as the portion extends in the −x direction from the feeding point that is the contact point with the first plate-shaped metal 10. The magnetic core 73 is disposed in a space resulting from the curving. Protruding portions 23*a* protruding in the +z direction are respectively disposed on respective x-direction end portions at +z-direction side end portions of the vertically extending portion 23. The protruding portions 21*a* and the protruding portions 23*a* are located on respective sides of the GNSS antenna element 60 in the x direction so as not to cover the y-direction side of the GNSS antenna element 60, as shown in FIG. 6, while ensuring a required area as an element of the bow-tie antenna, so that the protruding portions 21*a*, 21*b* can be expected to play a role of suppressing the influence on the GNSS antenna.

The TEL antenna substrate 45 is held on the upper surface of the base 40 substantially parallel to the xz plane and electrically connected to each of the portions corresponding to the vertexes of the first plate-shaped metal 10 and the second plate-shaped metal 20, and each of the connecting points acts as a feeding point. The feeding point is located at a position offset in the +x direction from the x-direction center position of the first plate-shaped metal 10. Therefore, as shown in FIG. 6, the feeding point is shifted by a predetermined distance in the +x direction with respect to the imaginary line Lc parallel to the z direction and passing through the middle point of the edge 10*d* of the first plate-shaped metal 10 that faces the feeding point. Thus, in this embodiment, a larger distance is formed between the feeding point and the imaginary line Le, that is parallel to the z direction and is tangent to the −x-direction side end point of the first plate-shaped metal 10, so that the magnetic cores 71 to 73 do not protrude beyond the imaginary line Le toward the −x direction when viewed along the y axis, perpendicular to the xz plane, as shown in FIG. 6. In other words, since the magnetic cores 71 to 73 are entirely accommodated between the −x-direction side end point of the first plate-shaped metal 10 and the feeding point in the x direction, the base 40 and the cover 80 constituting the case can be reduced in size so as to restrain an increase in product size while suppressing leakage current. The TEL antenna substrate 45 is provided with a matching circuit.

The GNSS antenna substrate 50 is screwed and fixed to the upper surface of the base 40 in substantially parallel to the xy plane so as to sandwich the connecting portions 22 of the second plate-shaped metal 20. A substantially full GND pattern is disposed on the back surface (the surface on the −z-direction side) of the GNSS antenna substrate 50, and the GND pattern and the connecting portions 22 of the second plate-shaped metal 20 are electrically connected to each other. The GNSS antenna element 60 is mounted on the main surface (the surface on the +z-direction side) of the GNSS antenna substrate 50. A phase adjustment circuit, a coupled circuit, a bandpass filter, a low noise amplifier (LNA), a signal distribution circuit, etc. are disposed on the main surface of the GNSS antenna substrate 50. Feeding pins 61, 62 electrically connect electrodes (e.g., silver electrodes) on the surface of the GNSS antenna element 60 and the main surface of the GNSS antenna substrate 50 to each other. In the signal distribution circuit, for example, a Wilkinson distributor can be formed on the GNSS antenna substrate 50.

The feeder line 31 serving as the first coaxial cable has a center conductor electrically connected via the TEL antenna substrate 45 to the first plate-shaped metal 10 and an outer conductor electrically connected via the TEL antenna substrate 45 to the second plate-shaped metal 20. The tubular (e.g., cylindrical) magnetic core 71 for reducing a leakage current is mounted on the feeder line 31 (the feeder line 31 penetrates the magnetic core 71). The feeder lines 32, 33 serving as the second and third coaxial cables have center conductors electrically connected to signal lines (two respective signal lines distributed by the signal distribution circuit) of the GNSS antenna substrate 50, and outer conductors electrically connected to the GND pattern of the GNSS antenna substrate 50. The tubular (e.g., cylindrical) magnetic cores 72, 73 for reducing a leakage current are respectively mounted on the feeder lines 32, 33 (the feeder lines 32, 33 penetrate the respective magnetic cores 72, 73). The magnetic cores 71 to 73 are held at the x-direction positions equal to each other on the upper surface of the base 40 such that the axial direction is substantially parallel to the x direction. Terminals of the feeder lines 31 to 33 are attached to the connector 48. In this embodiment, the magnetic cores 71 to 73 have outer circumferential surfaces covered with respective sponge-like cushioning materials 81 to 83 so as to prevent direct contact with each other.

Although the present invention has been described hereinabove referring to the embodiments as examples, it is to be understood by those skilled in the art that the constituent elements and processing processes in the embodiments are variously modified without departing from the scope defined by the appended claims.

What is claimed is:

1. An antenna device comprising:

a bow-tie antenna as a first antenna and including first and second triangular metal plates lying in an xz plane of a three-dimensional coordinate system having an x-axis, a y-axis, and a z-axis that are mutually perpendicular to each other, wherein each of the first and second triangular metal plates includes first, second, and third edges and first, second, and third vertexes respectively opposite the first, second, and third edges, the first vertexes of the first and second triangular metal plates are directly opposite each other at a feeding point of the bow-tie antenna, and the feeding point of the bow-tie antenna is on a first side of a first line that passes through at least one of centers of the first edges of the first and second triangular metal plates and that is parallel to the z-axis;

a first coaxial cable connected to the feeding point of the bow-tie antenna; and a first tubular magnetic core having a central axis along an axial direction of the first tubular magnetic core, wherein the first coaxial cable passes through the first tubular magnetic core, the axial direction of the first tubular magnetic core is parallel to the x-axis, the first tubular magnetic core is located on a second side, opposite the first side, of the first line, the first and second triangular metal plates extend, in an x-axis direction, beyond the first line to respective second vertexes of the first and second triangular metal plates, and the first tubular magnetic core is located between the feeding point of the bow-tie antenna and a second line that is tangent to at least one of the second vertexes of the first and second triangular metal plates and that is parallel to the z-axis, when viewed along the y-axis, perpendicular to the xz plane.

2. The antenna device according to claim 1, wherein the first tubular magnetic core is located entirely between the feeding point of the bow-tie antenna and the second line that is tangent to at least one of the second vertexes of the first and second triangular metal plates and that is parallel to the z-axis, when viewed along the y-axis, perpendicular to the xz plane.

3. The antenna device according to claim 1, further comprising a second antenna that is not a bow-tie antenna, second and third coaxial cables connected to the second antenna, and second and third tubular magnetic cores through which the second and third coaxial cables respectively pass, wherein the first, second, and third tubular magnetic cores are stacked in a trefoil formation.

4. An antenna device comprising:

a bow-tie antenna as a first antenna and including a trapezoidal metal plate and a semicircular metal plate, wherein the trapezoidal metal plate and the semicircular metal plate lie in an xz plane of a three-dimensional coordinate system having an x-axis, a y-axis, and a z-axis that are mutually perpendicular to each other, the trapezoidal metal plate has first and second vertexes at opposite first and second end points of the trapezoidal metal plate, along the x-axis, and the bow-tie antenna has a feeding point where the trapezoidal metal plate contacts the semicircular metal plate;

a first coaxial cable connected to the feeding point of the bow-tie antenna; and a first tubular magnetic core having a central axis along an axial direction of the first tubular magnetic core, wherein the first coaxial cable passes through the first tubular magnetic core, the axial direction of the first tubular magnetic core is parallel to the x-axis, the first tubular magnetic core is located between the feeding point of the bow-tie antenna and a line that is parallel to the z-axis and tangent to the first end point of the trapezoidal metal plate, and distance from the feeding point of the bow-tie antenna to the first vertex at the first end point of the trapezoidal metal plate is longer than distance from the feeding point of the bow-tie antenna to the second vertex at the second end point of the trapezoidal metal plate, and the first tubular magnetic core is disposed between the feeding point of the bow-tie antenna and the line tangent to the first vertex at the first end point of the trapezoidal metal plate, when viewed along the y-axis, perpendicular to the xz plane.

5. The antenna device according to claim 4, wherein the first tubular magnetic core is located entirely between the feeding point of the bow-tie antenna and the line that is parallel to the z-axis and tangent to the first vertex at the first end point of the trapezoidal metal plates, when viewed along the y-axis, perpendicular to the xz plane.

6. The antenna device according to claim 4, further comprising:

a second antenna that is not a bow-tie antenna, second and third coaxial cables connected to the second antenna, and second and third tubular magnetic cores through which the second and third coaxial cables respectively pass, wherein the first, second, and third tubular magnetic cores are stacked in a trefoil formation.

7. An antenna device comprising:

a bow-tie antenna as a first antenna and including first and second metal plates lying in an xz plane of a three-dimensional coordinate system having an x-axis, a y-axis, and a z-axis that are mutually perpendicular to each other, wherein the first and second metal plates extend along the z-axis and the first metal plate extends a longer distance along the z-axis than the second metal plate extends along the z-axis, the second metal plate has a convex portion facing the first metal plate, the bow-tie antenna has a feeding point where the first metal plate contacts the second metal plate, and the first metal plate has first and second end points along the x-axis and the feeding point of the bow-tie antenna is located closer to the first end point of the first metal plate than to the second end point of the first metal plate;

a first coaxial cable connected to the feeding point of the bow-tie antenna;

a first tubular magnetic core having a central axis along an axial direction of the first tubular magnetic core, wherein the first coaxial cable passes through the first tubular magnetic core, and the axial direction of the first tubular magnetic core is parallel to the x-axis;

a second antenna that is not a bow-tie antenna;

a second coaxial cable connected to the second antenna;

a second tubular magnetic core having a central axis along an axial direction of the second tubular magnetic core, wherein the second coaxial cable passes through the second tubular magnetic core, and the first tubular magnetic core is located between the feeding point of the bow-tie antenna and a line parallel to the z-axis and tangent to the second end point, when viewed along the y-axis, perpendicular to the xz plane.

8. The antenna device according to claim 7, wherein the first tubular magnetic core is located entirely between the feeding point of the bow-tie antenna and the line that is tangent to the second end point of the first metal plate and that is parallel to the z-axis, when viewed along the y-axis, perpendicular to the xz plane.

9. The antenna device according to claim 7, further comprising:

a third coaxial cable, wherein the second and third coaxial cables are connected to the second antenna, and a third magnetic core, wherein the third coaxial cable passes through the third tubular magnetic core, and the first, second, and third tubular magnetic cores are stacked in a trefoil formation.

* * * * *